US005794680A

United States Patent [19]

Xue

[11] Patent Number: 5,794,680

[45] Date of Patent: Aug. 18, 1998

[54] RETRACTABLE ARCED WINDOW COVERING

[76] Inventor: Suli Xue, 217 E. Magna Vista Ave., Aracdia, Calif. 91006

[21] Appl. No.: 778,618

[22] Filed: Jan. 8, 1997

[51] Int. Cl.[6] ..... E06B 9/06

[52] U.S. Cl. ..... 160/84.07; 160/134

[58] Field of Search ..... 160/84.07, 134, 160/178.2 R, 330, 38

[56] References Cited

U.S. PATENT DOCUMENTS

| | | | |
|---|---|---|---|
| 1,609,877 | 12/1926 | Kendall | 160/134 X |
| 4,699,195 | 10/1987 | Lester . | |
| 4,776,380 | 10/1988 | Lester . | |
| 4,934,436 | 6/1990 | Schnebley | 160/84.07 |
| 5,010,939 | 4/1991 | King . | |
| 5,044,418 | 9/1991 | Donahue . | |
| 5,050,661 | 9/1991 | Sikkema et al. | 160/134 X |
| 5,117,889 | 6/1992 | Coe | 160/134 |
| 5,159,966 | 11/1992 | Fleishman et al. . | |
| 5,168,912 | 12/1992 | Jelic et al. | 160/84.07 |
| 5,183,092 | 2/1993 | Jelic . | |
| 5,584,329 | 12/1996 | Thomas | 160/84.07 X |
| 5,623,982 | 4/1997 | Okazaki | 160/178.2 R |
| 5,662,153 | 9/1997 | Rosenblatt | 160/84.07 |

FOREIGN PATENT DOCUMENTS

| | | |
|---|---|---|
| 024065 (A1) | 10/1987 | European Pat. Off. . |
| 2514701 (A1) | 10/1976 | United Kingdom . |
| WO 91/00408 | 1/1991 | WIPO . |

*Primary Examiner*—David M. Purol
*Attorney, Agent, or Firm*—Richard C. Litman

[57] ABSTRACT

A retractable arced window covering for arced windows. The invention is a pleated fan covering for arced windows which can be remotely operated by a pull cord for opening and closing the covering. The arced window covering includes a base which hides the retracted covering, a first arced track extending from the base, and a foldable pleated member which is suspended from the track and can be drawn along the track using a cord. The present invention has a second embodiment in which there are two foldable pleated members that can be drawn along the track in opposite directions and in unison from a horizontal retracted position to an expanded position such that the pleated members meet at the apex of the arced window. Both embodiments of the arced window covering include a locking mechanism capable of holding the cord and the foldable pleated member in a selected position. The present invention also includes a cover which is placed over the track to conceal the inner workings of the invention and to give it an attractive appearance.

18 Claims, 9 Drawing Sheets

RETRACTABLE ARCED WINDOW COVERING

BACKGROUND OF THE INVENTION

1. Field of the Invention

The present invention relates to a retractable covering for arced windows. More specifically, the invention is a pleated fan covering for arced windows which can be remotely operated by a pull cord for opening and closing the covering.

2. Description of Prior Art

Many new buildings and homes are designed with arced windows or palladian style windows and doors. Today there exist several types of coverings for arced windows, but they tend to be either permanently fixed and not retractable or they are removable. There do exist several retractable style arced window covers. The current retractable style arced window covers lack aesthetic appeal due to their retractable design which can severely diminish their value as a decorative item. Other current retractable style arced window covers use complex and inefficient mechanisms to accomplish their goal.

Consequently there is a need for a retractable arced window cover that can be remotely operated to open or close. The covering must be designed to hide the mechanical elements of the invention and to hide the covering when the covering is in the retra position in order to give it an aesthetically pleasing appearance. The covering should be capable of preventing the passage of direct sunlight while the covering is in the expanded position and should protect the privacy of the person using the window covering. Furthermore, the covering should accomplish these goals using a simple mechanical structure which requires low-cost and lightweight materials.

U.S. Pat. No. 4,699,195, issued on Oct. 13, 1987, and U.S. Pat. No. 4,776,380, issued on Oct. 11, 1988, to Lance Lester describe a blind for use in an arched window which includes a U-shaped frame with two sets of blades that fan out of either side of the frame and meet at the top where they are latched together to hold the blind in place. The patents to Lester fail to describe a blind that can be remotely operated and they fail to describe a blind that is designed to hide the mechanical elements of the invention in order to give it an aesthetically pleasing appearance.

U.S. Pat. No. 5,010,939, issued on Apr. 30, 1991, to William J. King describes an arched window blind formed of a fan-folded material that uses a central transmission mechanism for opening and closing the blind. The patent to King describes a blind which uses a complex mechanical structure to achieve a retractable design.

U.S. Pat. No. 5,044,418, issued on Sep. 3, 1991, to Nadine G. Donahue describes an arch-shaped window treatment having a frame and a flexible fabric mounted thereon. The paten Donahue fails to describe a retractable arced window covering.

U.S. Pat. No. 5,117,889, issued on Jun. 2, 1992, to David G. Coe describes an arched window blind constructed of multiple slats strung together which pivot either manually or mechanically from a rigid base to cover the window. The patent to Coe has relatively complex structure and appears to fail to cover the entire arced window.

U.S. Pat. No. 5,159,996, issued on Nov. 3, 1992, to Ron Fleishman et al. describes a fan-type arched window covering having compression plates which engage the opposed sides of the radial pleats to partially compress and give rigidity to the pleats and enable adjustment of the pleats to accommodate irregularities in the window casing with the covering standing on its own without top brackets. The patent to Fleishman et al. does not describe a window covering which can be folded or opened.

U.S. Pat. No. 5,168,912, issued on Dec. 8, 1992, to Ralph Jelic et al. describes an operable arched window blind having a pleated fabric configuration. The patent to Jelic et al. fails to describe a blind that is designed to hide all the mechanical elements of the invention in order to give it an aesthetically pleasing appearance. Additionally, the pivoting means for the blind described in the patent to Jelic et al. has the potential of causing problems during repeated pivoting of the blind if the first and second hinge segments slide relative to each other.

U.S. Pat. No. 5,183,092, issued on Feb. 2, 1993, to Ralph Jelic describes an operable arched window blind with a pull cord assembly for opening and closing the blind. The patent to Jelic fails to describe a blind that can hide the covering when the covering is in the retracted position in order to give it an aesthetically pleasing appearance. Additionally, the pivoting means for the blind described in the patent to Jelic has the potential of causing problems during repeated pivoting of the blind if the first and second hinge segments slide relative to each other.

German Patent Application Number 2,514,701 (A1), published on Oct. 14, 1976, describes a curtain-like screen for windows or for use as room dividers having a series of strip-like elements attached to a stiff common guide member. PCT International Publication Number WO 91/00408, published on Jan. 10, 1991, describes a manual deployment apparatus for specially pleated or multi-cellular window coverings including uniquely hinged mounting rails and single continuous strand pull cords. Both patent applications fail to describe a window covering device that can hide the covering when the covering is in the retracted position in order to give it an aesthetically pleasing appearance.

European Patent Application Number 240,065 (A1), published on Oct. 7, 1987, describes a folding curtain screen structure for a triangular window having pull cords which when operated a horizontal lower bar rises until it becomes flush with an upper bar thereby folding the screening material. The European patent application fails to describe an arced window covering.

None of the above inventions and patents, taken either singularly or in combination, is seen to describe the instant invention as claimed. Thus a retractable arced window covering solving the aforementioned problems is desired.

SUMMARY OF THE INVENTION

The present invention relates to a retractable covering for arced windows. More specifically, the invention is a pleated fan covering for arced windows which can be remotely operated by a pull cord for opening and closing the covering. The arced window covering includes a base which hides the retracted covering, an arced track extending from the base, and a foldable pleated member which is suspended from the track and can be drawn along the track using a cord. The present invention has a second embodiment in which there are two foldable pleated members that can be drawn along the track in opposite directions and in unison from a horizontal retracted position to an expanded position such that the pleated members meet at the apex of the arced window. Both embodiments of the arced window covering include a locking mechanism capable of holding the cord and the foldable pleated member in a selected position. The present invention also includes a cover which is placed over the track to conceal the inner workings of the invention and to give it an attractive appearance.

Accordingly, it is a principal object of the invention to provide a covering for arced windows that can be remotely operated to open or close.

It is another object of the invention to provide a covering for arced windows that is designed to hide the mechanical elements of the invention in order to give it an aesthetically pleasing appearance.

It is a further object of the invention to provide a covering for arced windows that is capable of preventing the passage of direct sunlight while the covering is in the expanded position and hides the covering when the covering is in the retracted position.

A further object of the invention is to provide a covering for arced windows that protects the privacy of the user.

Still another object of the invention is to provide a covering for arced windows with a simple mechanical structure which requires low-cost and lightweight materials.

It is an object of the invention to provide improved elements and arrangements thereof in an retractable arced window covering for the purposes described which is inexpensive, lightweight, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
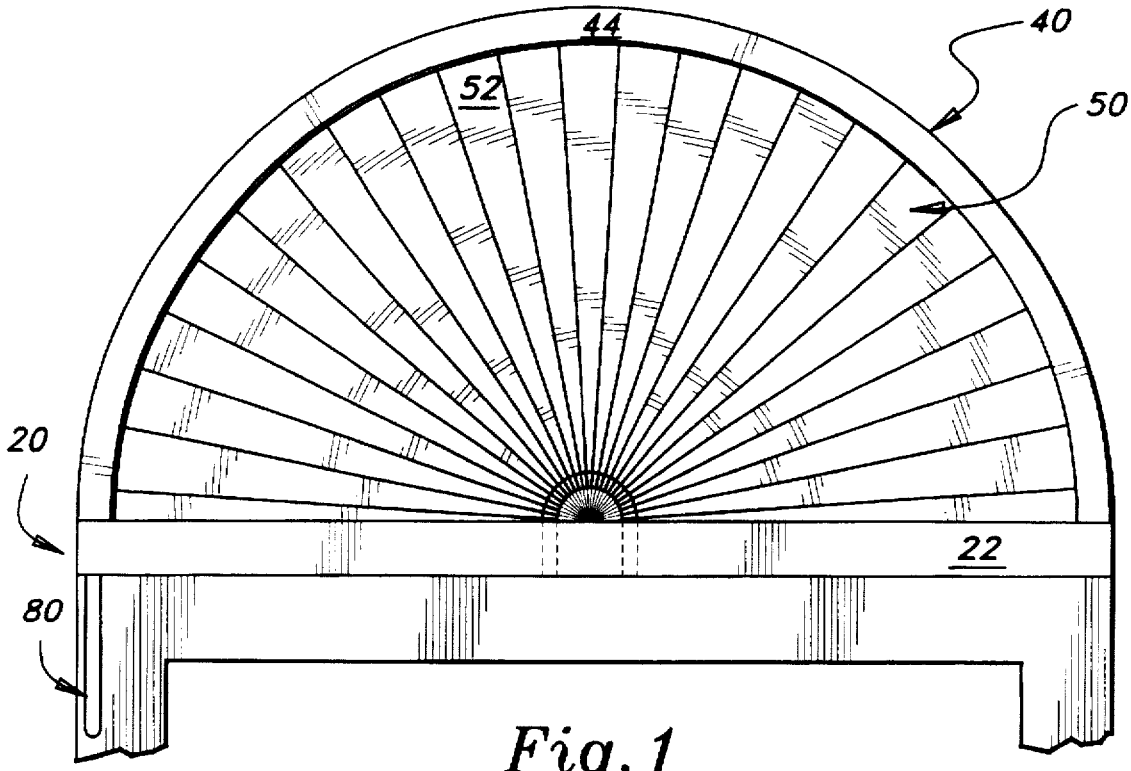
FIG. 1 is an elevational, environmental view of the first embodiment of the present invention showing the window covering in the expanded position.
Figure 2:
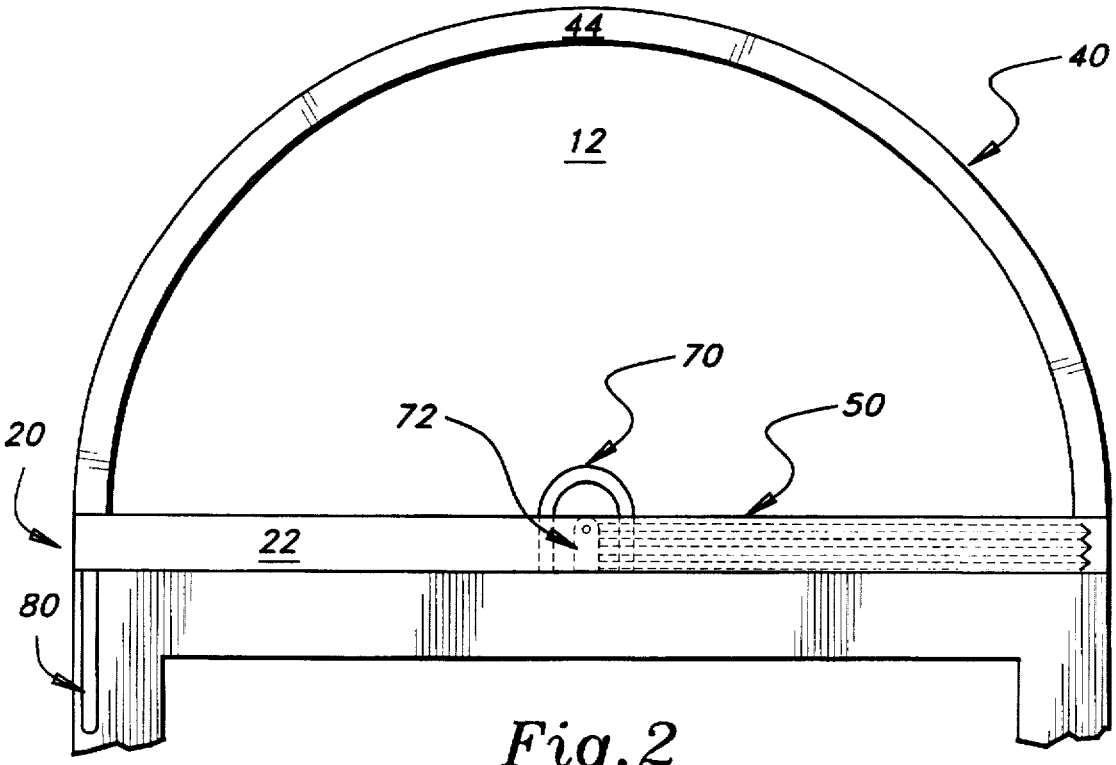
FIG. 2 is an elevational, environmental view of the first embodiment of the present invention showing the window covering in the retracted position.
Figure 3:
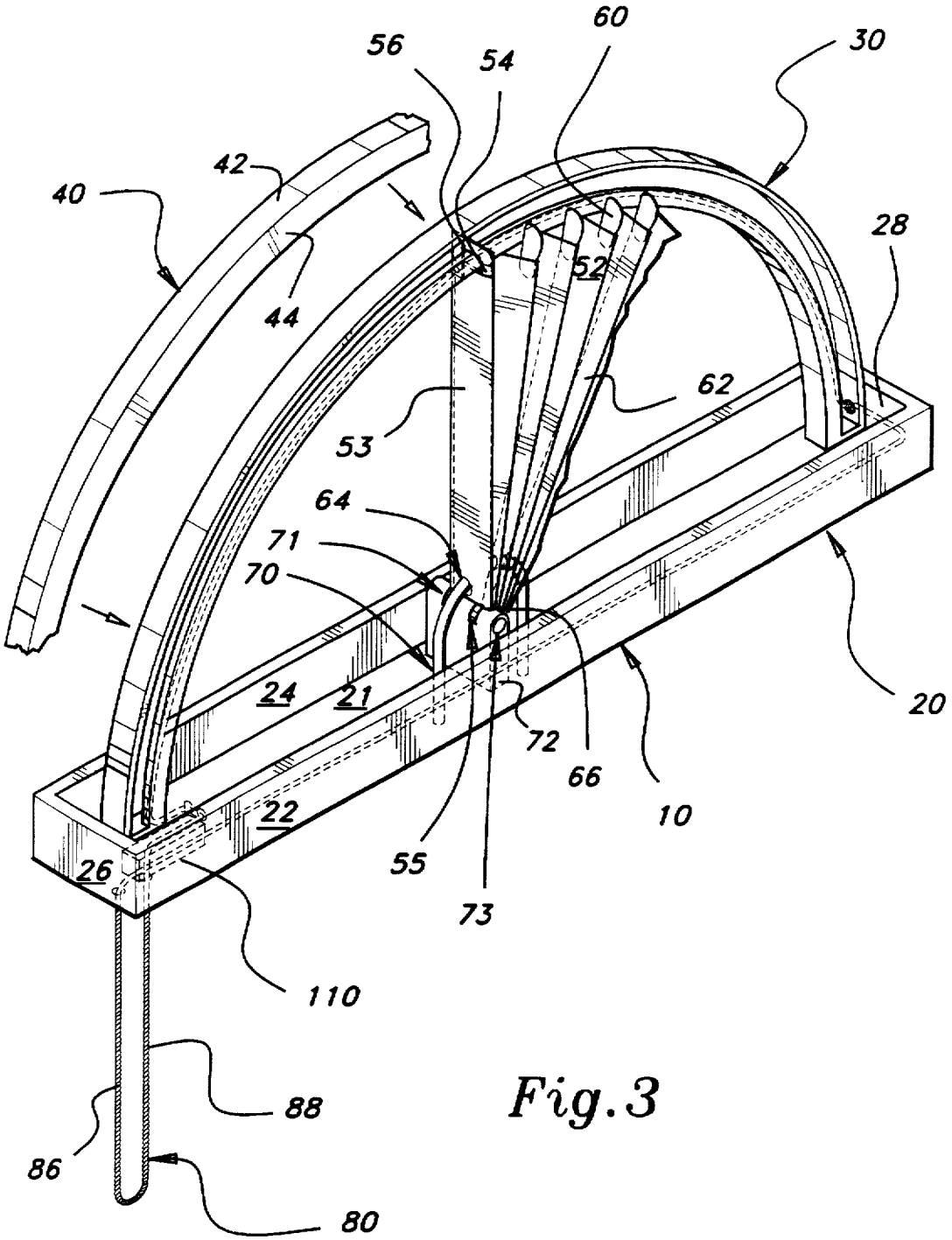
FIG. 3 is a perspective, partially fragmented view of the first embodiment of the present invention showing the details of structure of the window covering.
Figure 5:
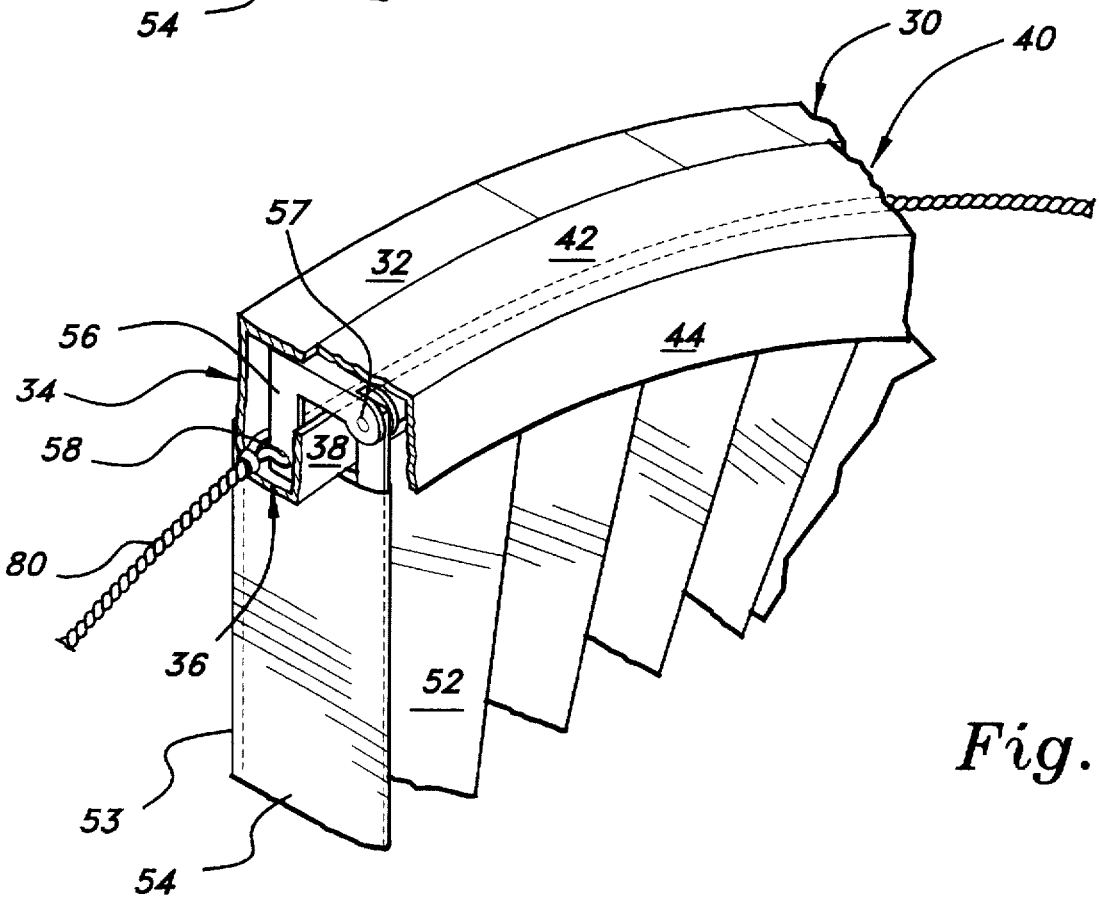
FIG. 5 is an enlarged scale, fragmented perspective view of a shade arm railway and string tunnel with a cover in position.
Figure 6:
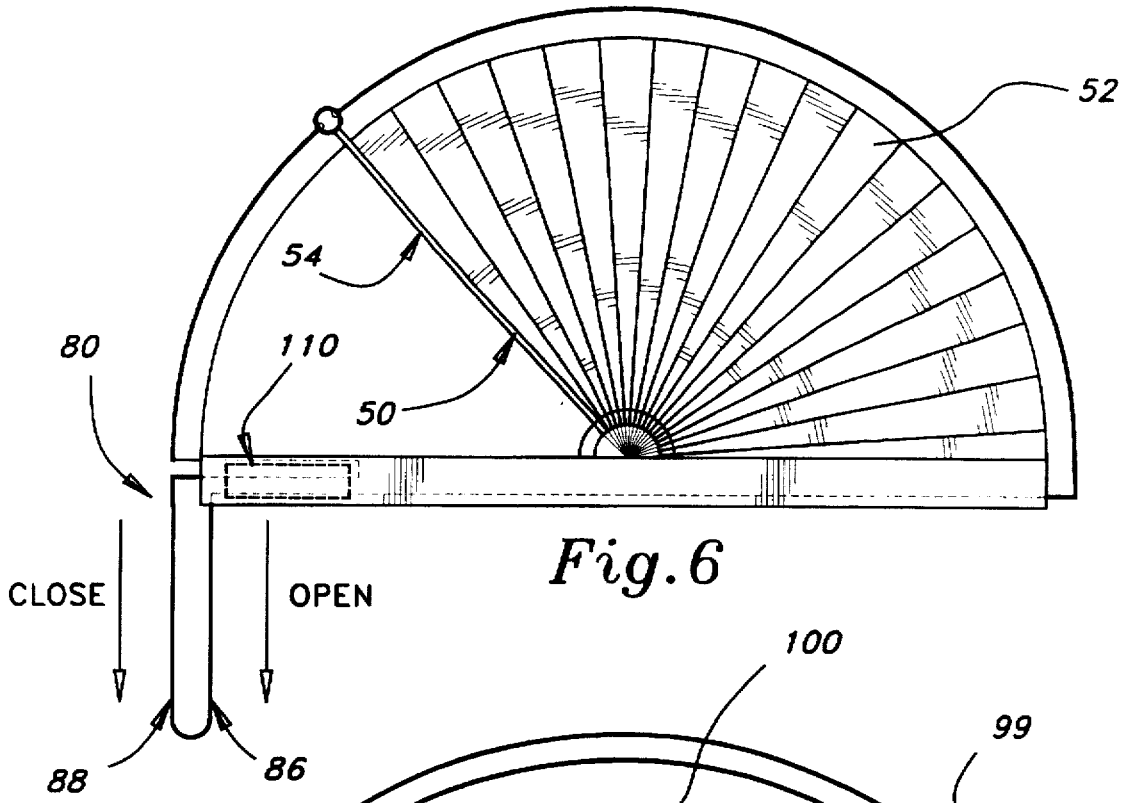
FIG. 6 is an elevational, environmental view of the present invention showing a string path used in the first embodiment.
Figure 7:
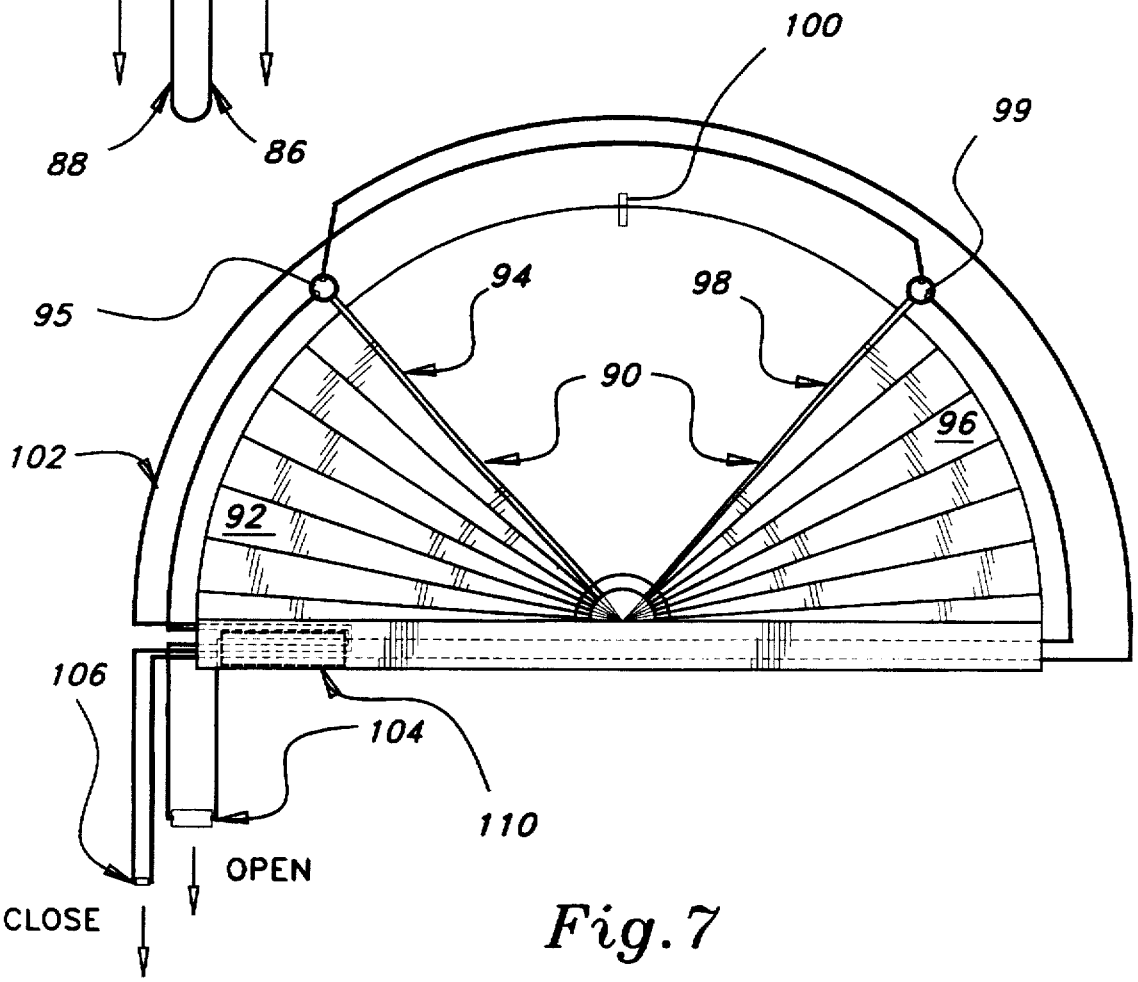
FIG. 7 is an elevational, environmental view of the present invention showing a string path used in the second embodiment.
Figure 10:
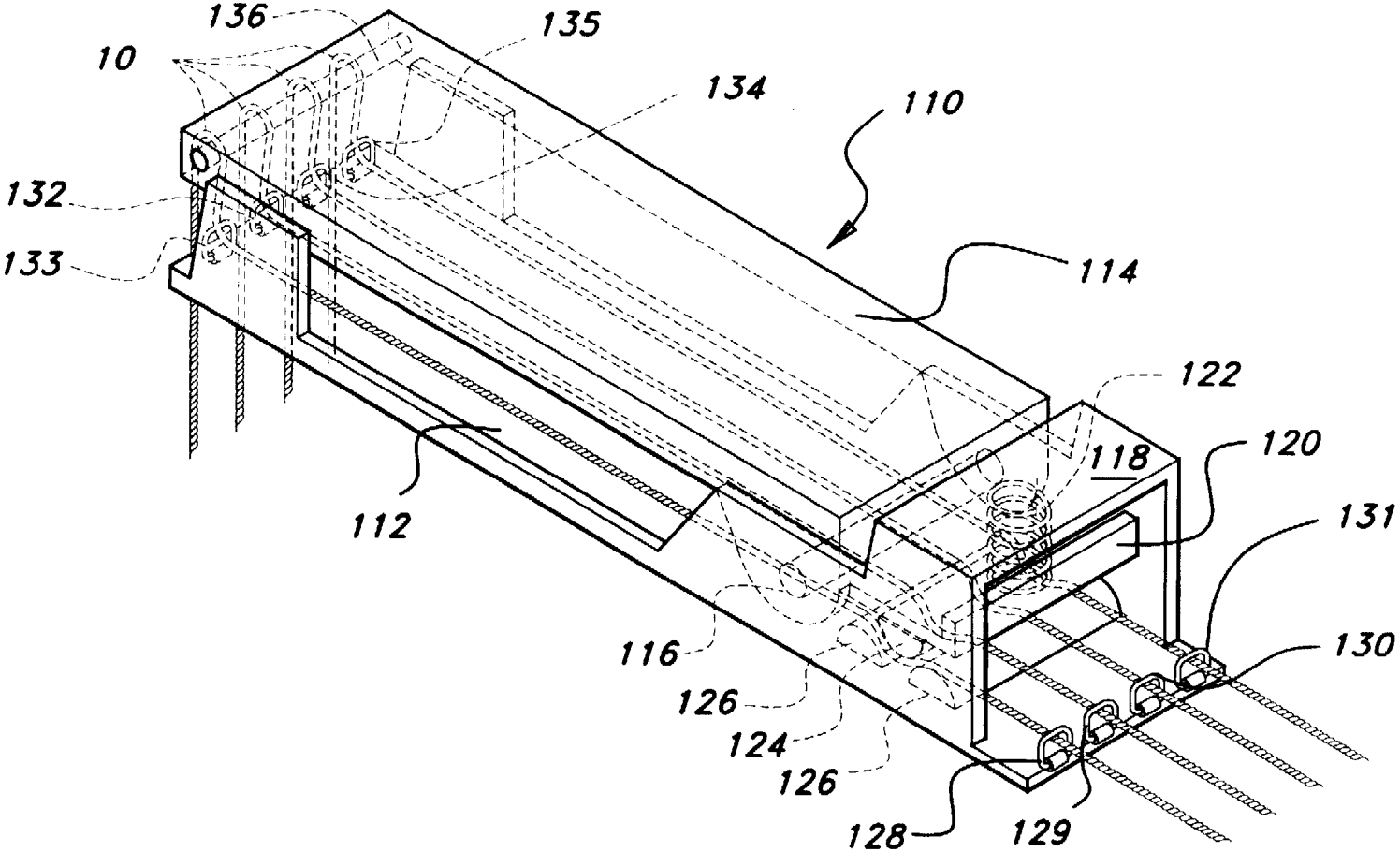
FIG. 10 is an enlarged perspective view of a locking mechanism of the second embodiment.
Figure 11:
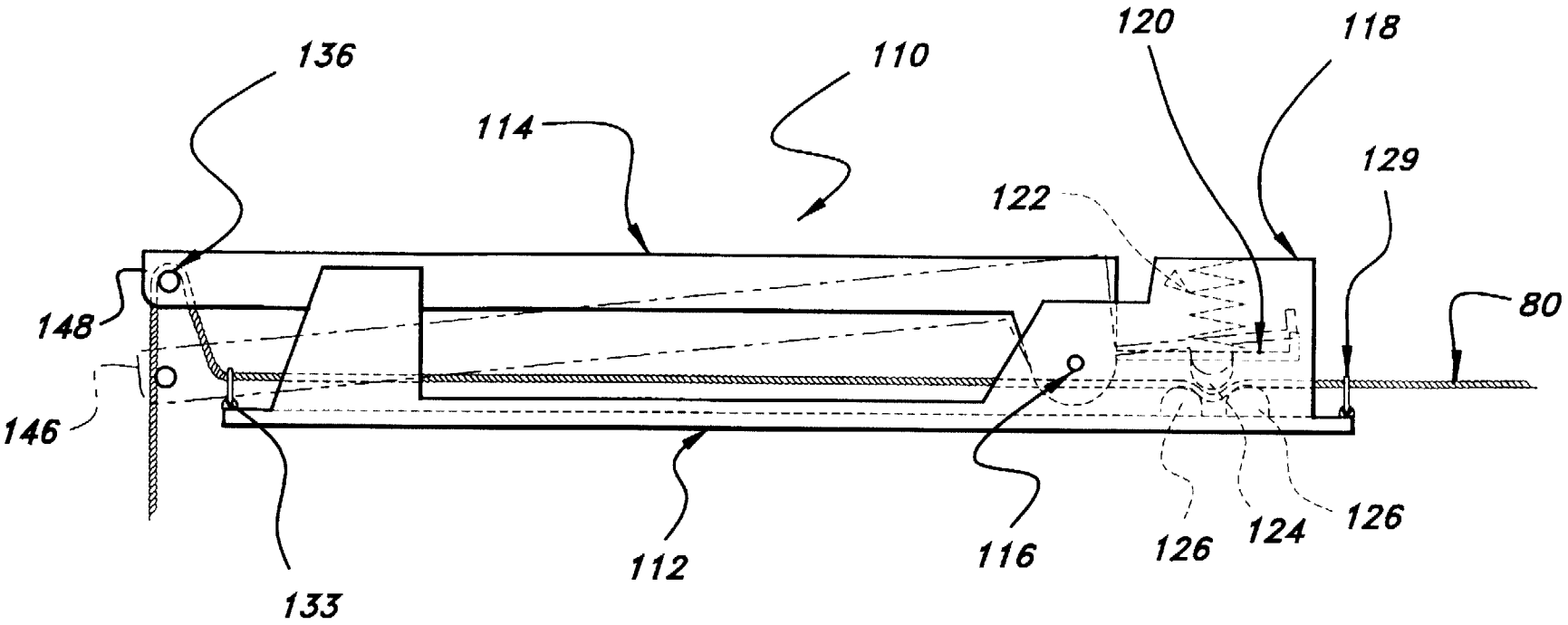
FIG. 11 is an enlarged side view of a locking mechanism of the second embodiment showing the beam member in the locked position (solid lines) and in the unlocked position (dashed lines).

FIGS. 1 through 6 show the first embodiment of the retractable arced window covering. Referring to FIG. 3, the first embodiment of the present invention 10 includes a base 20, a first arced track member 30, a rigid member 54, an arcuately foldable member 52, a second arced track member 70, and a cord 80 capable of pulling the rigid member 54 along the first track member 30. The second embodiment is shown in FIG. 7 and it includes a base 20, a first arced track member 30, a first and a second rigid member, 94 and 98 respectively, a first and a second arcuately foldable member, 92 and 96 respectively, a second arced track member 70, and a cord 102 capable of pulling the first and the second rigid members, 94 and 98, in opposite directions and in unison along the first track member 30. Both the first and the second embodiments include a locking mechanism 110, the second embodiment of which is shown in FIGS. 10 and 11.

The first embodiment of the present invention 10 relates to a retractable arced window covering including a base 20 having a bottom side 21, a front side 22, a rear side 24, a left side 26, and a right side 28. Typically the rear side 24 would be adjacent to the arced window 12. The base 20 can be constructed of decorative wood or sheet metal or rigid plastic, or any other similar material. The four vertical sides, 22, 24, 26, and 28, hide from view the foldable member 52 when the foldable member 52 is in a retracted position upon the base 20, as is depicted in FIG. 2. In this position the arced window 12 is uncovered and the maximum amount of light is allowed to travel through the window 12. One of the benefits of the present invention is that the beauty of the arced window is completely undisturbed by the covering 10 when it is in the retracted position.

The base 20 is sized so that it can sit on the inside window sill of the arced window. The present invention can either be free standing or it can be mounted to the window sill. The retractable arced window covering 10 has a simple yet elegant appearance when in the retracted position, as shown in FIG. 2, due to the fact that only the front cover wall 44, the base front wall 22, the second arced track member 70, and the lower portion of the cord 80 can be seen. The covering 10 also has a simple yet elegant appearance when in the expanded position, as shown in FIG. 1, due to the fact that only the front cover wall 44, the base front wall 22, the pleated foldable member 52, and the lower portion of the cord 80 can be seen. The covering 10 can be decorated with a design or color that matches the room color or wallpaper. The covering 10 may also be decorated to depict a painting.

Figure 4:
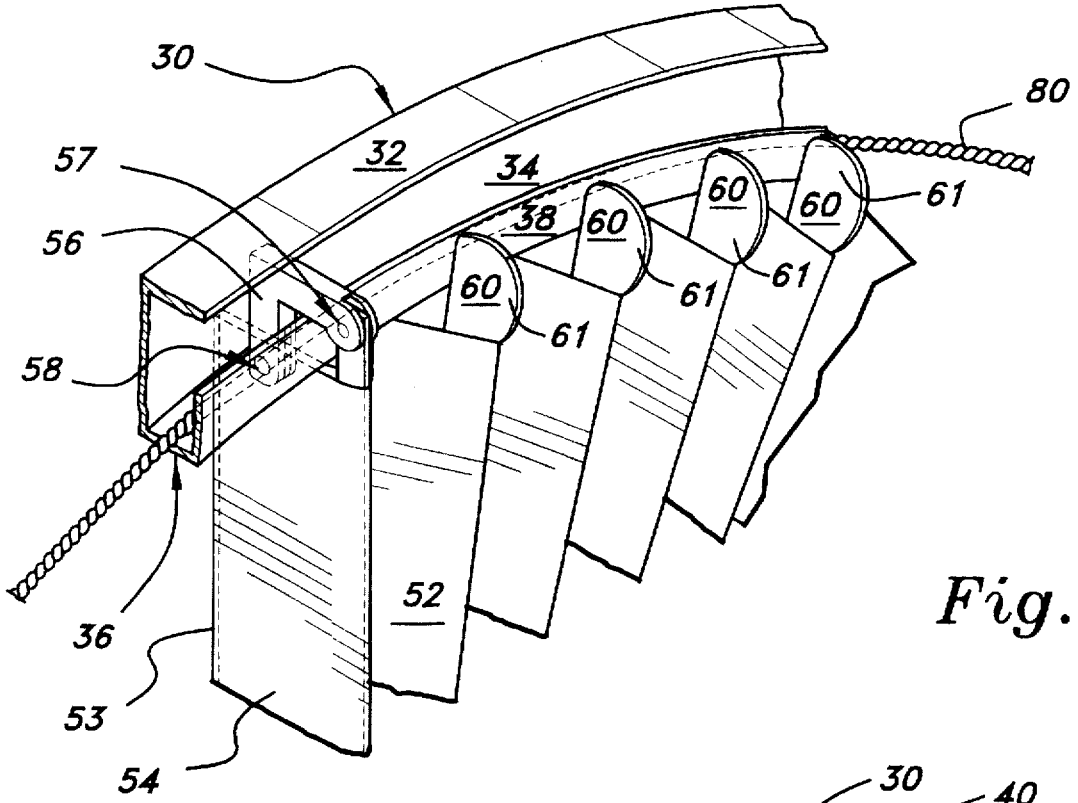
FIG. 4 is an enlarged scale, fragmented perspective view of a shade arm railway and string tunnel.

The present invention includes a first arced track member 30 rigidly attached to the base 20. The first track member 30 can be made of wood, metal, or rigid plastic, or any other similar material and can be attached to the base 20 using any conventional method, such as gluing, welding or bolting. Referring to FIGS. 4 and 5, first track member 30 includes a top wall 32, a bottom wall 36, and two side walls 34 and 38. There is an opening running the length of the first track member 30 which is defined by the gap between top wall 32 and side wall 38. The first track member 30 hides the cord 80 which runs through the center of the first track member 30. The side wall 38 may include an edge (not shown) that extends towards side wall 34 and which helps to prevent the cord 80 from sliding out of first track member 30.

Figure 12A:
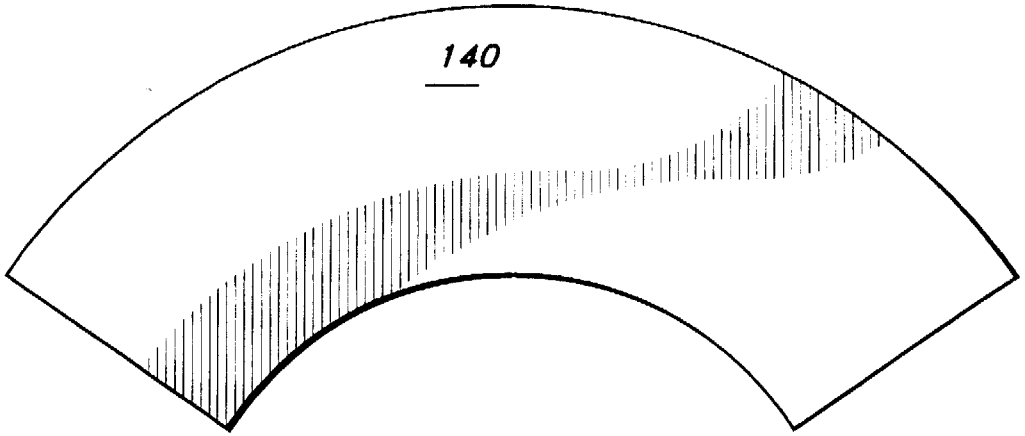
FIG. 12A is a perspective view of a foldable member in an unfolded state.
Figure 12B:
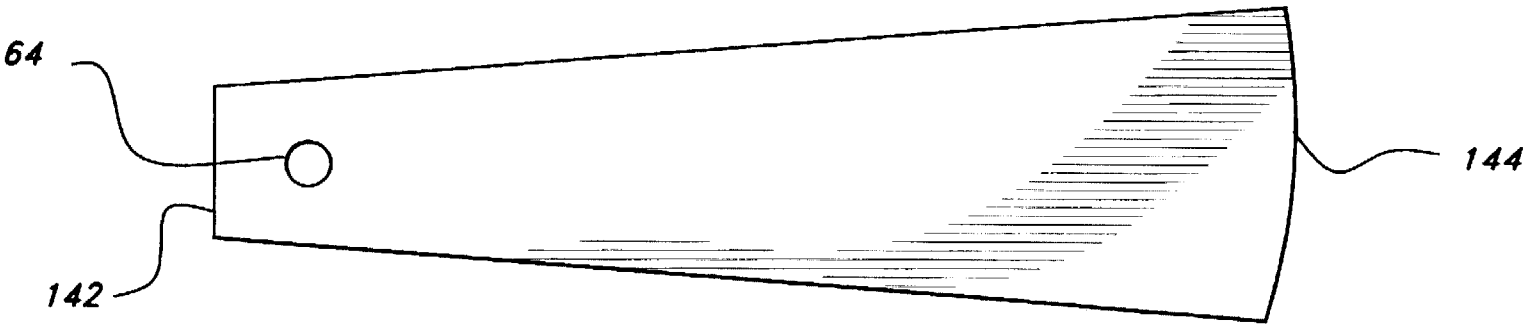
FIG. 12B is an enlarged side view of a foldable member in a folded state.

The covering 50 of the present invention includes an arcuately foldable member 52 which is preferably made of a stiff pleated fan-like fabric capable of preventing direct sunlight from passing through the window covering when in the expanded position. Preferably the foldable member 52 is formed by taking an arced piece of fabric 140, as shown in FIG. 12A, and folding the fabric until each pleat has a shape like that shown in FIG. 12B. The upper edges 144 of the pleats should be wider than the lower edges 142 of the pleats. The lower edge 142 should be cut straight in order to allow the foldable member 52 to rest flush with bracket 72 and unfold smoothly. One benefit of using an arced piece of fabric rather than a rectangular piece of fabric is that less material may be used to cover the same amount of area. The use of less material will reduce the thickness of the foldable member 52 when it is in the retracted position which also allows for the height of the base 20 to be reduced, thereby enhancing the aesthetic appeal of the arced window covering 10. Alternatively, the foldable member 52 may be formed from a rectangular shaped piece of fabric.

Referring to FIGS. 3, 4, 5, and 8, one end of the foldable member 52 has a sleeve 53 which holds a rigid member 54, while the other end is fixed to the base using any conventional method. The rigid member 54 is made of wood, metal, or rigid plastic, or any other similar material. In the preferred embodiment the upper end 56 of the rigid member 54 is hook-shaped with the upper end 56 being mounted such that it can pivot around pin 57. The upper end 56 of the rigid member 54 is slidably mounted within the opening between top wall 32 and side wall 38 of the first track member 30. The upper end 56 is pivotally mounted so that if the distance between the first track member 30 and the bracket 72 varies along the arc, then the rigid member 54 will not be prevented from sliding along the first track member 30 due to its rigidity. The cord 80 runs through a hole 58 on the end of the rigid member 54. The cord 80 is attached to the end of the rigid member 54 so that the rigid member 54 cannot slide relative to the cord 80.

A plurality of rigid support members 62 may be attached to the foldable member 52 in order to give it rigidity. The support members 62 should extend from the lower end portion to the upper edge of the foldable member 52. The support member 62 can be attached using glue or they may be fit within fabric sleeves which are integrated into the foldable member 52 or by using any other conventional methods. The support members 62 can be made of wood, metal, rigid plastic, or any other suitable material. Depending on the size and the type of fabric used to make the foldable member 52, one support member per pleat may be necessary, or one every other pleat, or one every second pleat, etc. The larger the window and the more flexible the fabric, the larger the number of support members 62 which will be necessary. The number of support members 62 used should be kept to a minimum because they will increase the thickness of the foldable member 52 when in the retracted position and thereby increase the height of the base 20.

A cover portion 40 is removably attached to the first track member 30. The cover 40 is made or either wood, metal, or rigid plastic, or any other suitable material, and is attached to the first track member 30 near the base using conventional methods, such as screws. The cover 40 includes a top wall 42 and a front wall 44 which hangs down and blocks the inner workings of the arced window covering to give an aesthetically pleasing appearance to the covering.

The cover 40 and the front wall 38 of the first track member 30 define a channel. The upper edge of each pleat of the foldable member 52 has a balancing member 60 affixed thereto. On pleats with support members 62, the balancing member 60 and the support member 62 are preferably made from a single piece of material. The balancing member 60 extends into the channel and walls 38 and 44 prevent the foldable member 52 from falling in a direction perpendicular to the first track member 30. The balancing member 60 has a protruded portion 61 which extends out beyond the foldable member 52 in order to protect the foldable member 52 from rubbing and wearing on the cover 40. The balancing members 60 are attached using glue or they may be fit within fabric sleeves which are integrated into the foldable member 52 or they may be attached using any other conventional methods. The balancing members 60 can be made of wood, metal, rigid plastic, or any other suitable material.

Figure 8:
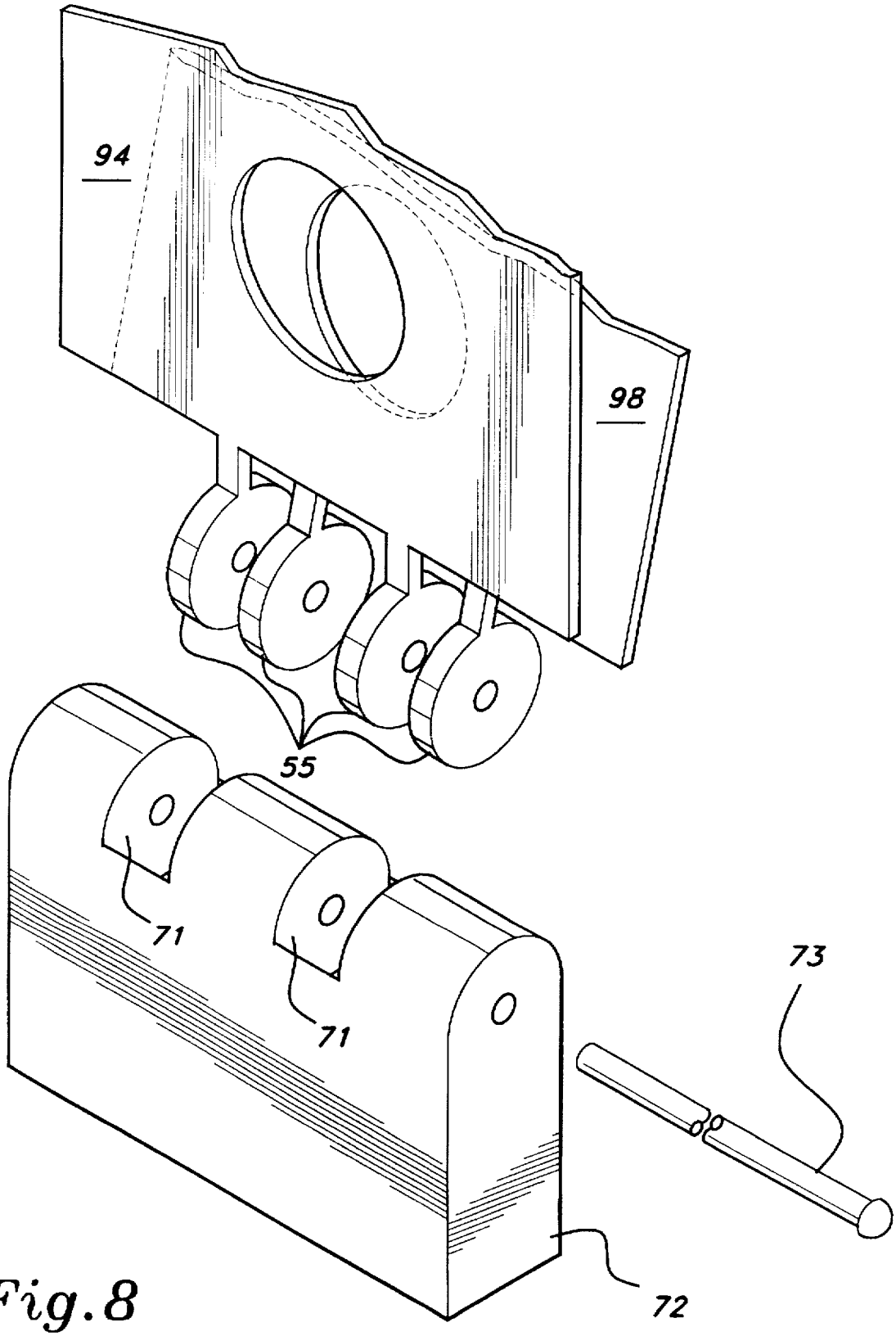
FIG. 8 is an enlarged, exploded, partially fragmented perspective view of a bracket and a pair of rigid members of the second embodiment.

The lower end of the foldable member 52 has a hole 64 through each pleat. A second track member 70 in the form of a U-shaped rod is attached to the bottom wall 21 of the base 20. The second track member 70 passes through each hole 64 thereby holding the lower end of the foldable member 52 in an attractive fan-like position. A bracket 72 is fixedly attached to the base 20 between the ends of the second track member 70. FIG. 8 shows an enlarged view of the bracket and rigid members of the second embodiment, which is identical to that in the first embodiment except that in the first embodiment there is only one rigid member 54. The rigid members 54, 94, and 98 each have a pair of integrally connected pivot members 55 at the lower end. The pivot members 55 sit within a pair of grooves 71 on the bracket 72 and the pivot members 55 are pivotally mounted on the bracket 72 by a rod 73. The rod 73 can be made of wood, metal, rigid plastic, or any other suitable material. The bracket 72 also contacts the lower end portion 66 of the foldable member 52 in order to help the foldable member 52 to more smoothly expand and retract.

A cord 80 is connected to the rigid member 54 as shown in FIG. 5. The cord 80 is capable of pulling the rigid member 54 along the first track member 30. The cord 80 runs through the first track member 30 and extends beyond each end of the first track member 30. The cord 80 hangs down below the base 20 so that it can be reached when the present invention is positioned on a window sill. Preferably the cord 80 is one continuous loop which extends up through the base 20 where one side of the cord 80 runs up the first track member 30 near wall 26 and the other side is directed around the foldable member 52 and towards the other end of the first track member 30 near wall 28. Alternatively, the cord 80 may extend from wall 26 through the first track member 30 to wall 28, where the cord 80 reverses direction back along the same path towards wall 26. This alternative cord 80 path eliminates the need for the cord 80 to travel along the length of base 20.

The cord 80 is guided within the base 20 and to the locking mechanism 110 by any conventional string guiding device such as a hoop (not shown). The cord 80, as it travels along the length of the base 20, may be protected from contact with the foldable member 52 by running the cord 80 through a rigid tube (not shown) or some other rigid tunnel (not shown) mounted to the base 20. The cord 80 extends down from the base 20 in a loop, as shown in FIGS. 3 and 6, such that when side 86 is pulled downward the foldable member 52 retracts and when side 88 is pulled downward the foldable member 52 expands. The cord 80 can also extend down from the base 20 with two separate ends protruding from the same side of the base 20 (not shown). Alternatively the present invention could eliminate the need for a guiding device, and eliminate the use of the locking mechanism 110, and have the ends of the cord 80 extending through the base 20 at the two points where the first track member 30 meets the base 20. The ends of the cord 80 will therefore protrude from opposite sides of the base 20 (not shown).

The first embodiment of the present invention preferably includes a locking mechanism 110 for locking the cord 80 whereby the rigid member 54 may be locked in any position along the first track member 30. While it is contemplated that any conventional locking mechanism may be used with the present invention, the preferred locking mechanism is described below. FIGS. 10 and 11 show a preferred locking mechanism of the second embodiment, which is identical to that in the first embodiment except that in the first embodiment there are only two sets of guide elements, 128 & 132 and 130 & 134, rather than four sets. The preferred locking mechanism of the first embodiment includes an elongated mounting member 112 mounted within the base 20, an elongated beam member 114, a spring 122, a pair of first guide elements, 128 and 130, a pair of second guide elements, 132 and 134, and a third guide element 136.

The mounting member 112 is pivotally connected to the beam member 114 by a rod 116. The mounting member 112 has an end portion 118 which has one end of a compression spring 122 affixed thereto. The beam member 114 has an end portion 120 which has the other end of the compression spring 122 affixed to one side and a jaw member 124 affixed to the opposite side. The mounting member 112 has a pair of jaw members 126 which are mounted opposite jaw member 124. The spring 122 forces jaw member 124 toward and in contact with jaw members 126.

In the first embodiment side 86 of the cord 80 extends through a first guide element 128, between the jaw members, 124 and 126, through a second guide element 132, and finally through a third guide element 136. The other side 88 of the cord 80 extends through a first guide element 130, between the jaw members, 124 and 126, through a second guide element 134, and finally through a third guide element 136. When either side, 86 or 88, of the cord 80 is pulled downward, the third guide element 136 is pulled towards the second guide elements, 132 and 134, thereby forcing the jaw member 124 away from the jaw members 126 and allowing the cord 80 to freely slide therebetween. Referring to FIG. 11, whenever the cord 80 is pulled the locking mechanism 110 is unlocked 146 automatically, and when the cord 80 is released the locking mechanism 110 locks 148 automatically. The length of the beam member 114, as well as the strength characteristics of the spring 122, may be varied in order to vary the amount of force needed to unlock the locking mechanism 110.

Referring to FIG. 7, the second embodiment of the present invention includes a base 20, a first arced track member 30, a first and a second rigid member, 94 and 98 respectively, a first and a second arcuately foldable member, 92 and 96 respectively, a second arced track member 70, and a cord 102 capable of pulling the first and the second rigid members, 94 and 98, in opposite directions and in unison along the first track member 30. FIG. 7 shows the details regarding the cord 102 configuration but for the sake of simplicity leaves out the details of the structure of the second embodiment because they are essentially identical to those of the first embodiment.

The covering 90 of the second embodiment of the present invention includes a first and a second arcuately foldable member, 92 and 96, which are preferably made of a stiff pleated fan-like fabric capable of preventing direct sunlight from passing through the window covering when in the expanded position. One end of the foldable members, 92 and 96, are attached to a rigid member, 94 and 98 respectively, while the other end is fixed to the base using any conventional method. The first and second rigid members, 94 and 98, of the second embodiment which are shown in FIGS. 7 and 8, are essentially identical to the first embodiment and are both slidably mounted within the opening between top wall 32 and side wall 38 of the first track member 30. The pivot members 55 on the bottom edge of the rigid members, 94 and 98, sit within a pair of grooves 71 on the bracket 72 and are pivotally mounted on the bracket 72 by a rod 73. The cord 102 is connected to both rigid members, 94 and 98, at points 95 and 99 respectively so that the rigid members, 94 and 98, cannot slide relative to the cord 102.

The cord 102 is capable of pulling the first and the second rigid members, 94 and 98, in opposite directions and in unison along the first track member 30. The cord 102 accomplishes this by making two parallel yet interconnected loops through the first track member 30, as shown in FIG. 7. The cord 102 is guided within the base 20 and to the locking mechanism 110 by any conventional string guiding device such as a hoop (not shown). The cord 102 extends down from the base 20 in a pair of loops, as shown in FIG. 7, such that when loop 104 is pulled downward the foldable members, 92 and 96, retract and when loop 106 is pulled downward the foldable members, 92 and 96, expand. The foldable members 92 and 96 are fully expanded when the rigid members, 94 and 98, meet at the apex of the first track member 30. A stopper 100 may be placed at the apex of the first track member 30 in order to prevent the rigid members, 94 and 98, from travelling along the first track member 30 beyond the apex. The stopper may be made of metal, plastic, rubber, or any other suitable material.

The foldable members 92 and 96 are light enough so that when they are in the fully expanded position the slight frictional forces on the cord 102 will be great enough to hold them in the expanded position. Alternatively some type of locking device may be employed to hold the rigid members 94 and 98 at the apex, such as the use of magnets, a small hook and loop fastener, or a latch to hold the rigid members, 94 and 98, together.

FIGS. 10 and 11 show a preferred locking mechanism of the second embodiment, which is identical to that in the first embodiment except that the second embodiment includes four sets of guide elements, 128 & 132, 129 & 133, 130 & 134, and 131 & 135, rather than only two sets. This locking mechanism 110 allows the foldable members, 92 and 96, to be held in a partially open position. The preferred locking mechanism of the second embodiment includes an elongated mounting member 112 mounted within the base 20, an elongated beam member 114, a spring 122, four first guide elements, 128, 129, 130, and 131, four second guide elements, 132, 133, 134, and 135, and a third guide element 136. In the second embodiment side 104 of the cord 102 extends through first guide elements 128 and 129, between the jaw members, 124 and 126, through second guide elements 132 and 133, and finally through a third guide element 136. The other side 106 of the cord 102 extends through first guide elements 130 and 131, between the jaw members, 124 and 126, through second guide elements 134 and 135, and finally through a third guide element 136. The locking mechanism of the second embodiment operates in an identical manner as the locking mechanism of the first embodiment.

The path of cords 80 and 102 can be diverted so that they protrude from the base 20 through front side 22, left side 26, and/or right side 28, so as to prevent any possible interference with the window sill that may occur due to the cords protruding from bottom side 21.

The first and second embodiments described above are particularly well suited for arced windows which are generally in the shape of a half circle. It is contemplated that the present invention can be used in arced windows of various shapes. For example, a third embodiment (not shown) of the present invention is contemplated in which the window covering is designed for use with a window which has the shape of a quarter circle.

The third embodiment (not shown) of the present invention 10 is merely a slightly modified version of the first embodiment. The third embodiment includes a vertical and a horizontal base, a first arced track member, a rigid member, an arcuately foldable member, a second arced track member, a bracket, a locking mechanism, and a cord capable of pulling the rigid member along the first track member. The locking mechanism, the second arced track member, and the bracket, as well as one end of the first track member, are connected to the horizontal base. The vertical base acts as a structural support by connecting the second end of the first track member with the horizontal base, and the vertical base acts as a means for hiding the cord 80.

Figure 9:
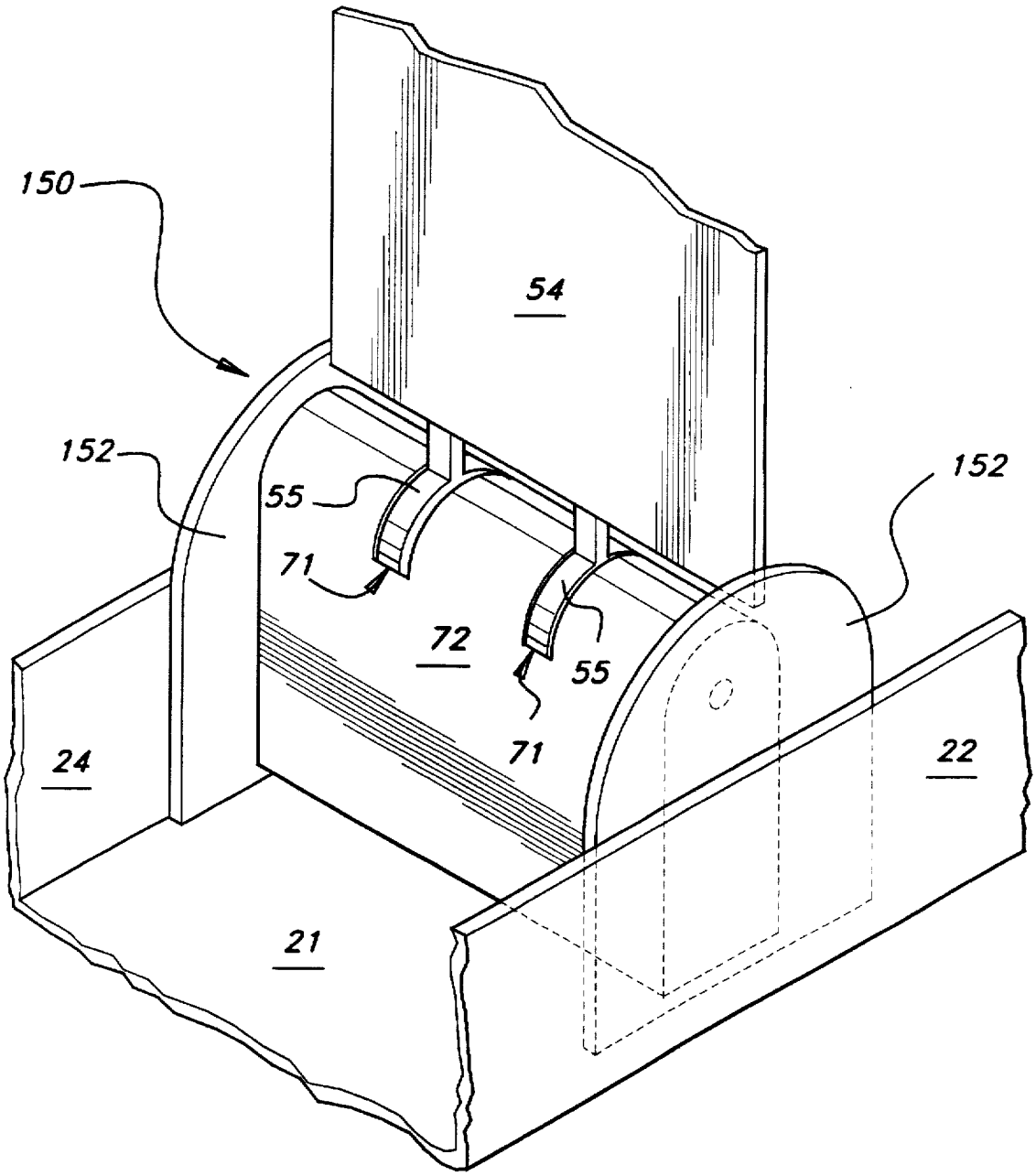
FIG. 9 is an enlarged, partially fragmented, perspective view of an alternative embodiment of a second track member shown in the first embodiment.

All three of the above described embodiments may be constructed using an alternative second track member 150, as shown in FIG. 9 for the first embodiment of the present invention. In this alternative embodiment, the original embodiment of the second arched track member 70 is eliminated, as well as, hole 64 in the foldable member 52. A pair of flat side members 152 are attached to the base 20 and to either end of bracket 72. The side members 152 form a channel which acts as a guide for the lower end portion of the foldable member 52. One benefit of this embodiment is the aesthetic benefit of eliminating the hole 64 and the second track member 70, and a second functional benefit is that by eliminating hole 64 sunlight will not be able to pass through foldable member 52.

It is to be understood that the present invention is not limited to the embodiments described above, but encompasses any and all embodiments within the scope of the following claims.

I claim:

1. A retractable arced window covering comprising:

a base;

an arced track member including an arced hollow tube having a lateral opening therein, said arced track member rigidly attached to said base;

a rigid member having a hook-shaped upper end pivotally mounted thereon, said upper end slidably mounted within said lateral opening of said arced tube;

an arcuately foldable member having an upper edge, a lower end portion, a first end and a second end, said first end being connected to said rigid member, said second end being connected to said base, said foldable member being adaptable to assume a retracted position, an expanded position, and all positions therebetween; and a remotely operable cord connected to said upper end of said rigid member, said cord being capable of pulling said rigid member in both directions along said track member.

2. The retractable arced window covering as defined in claim 1 wherein said base has a horizontal side with four sides projecting vertically upward therefrom, said sides hiding from view said foldable member when said foldable member is in a retracted position upon said base.

3. The retractable arced window covering as defined in claim 1 further comprising:

a cover portion attached to said track member, said cover portion and said track member defining a channel; and a balancing member fixed to said foldable member, said balancing member extending into said channel.

4. The retractable arced window covering as defined in claim 1 further comprising means for locking said cord thereby locking said rigid member whereby said rigid member may be locked in any position along said track member.

5. The retractable arced window covering as defined in claim 4 wherein said means for locking said cord comprises:

an elongated mounting member having a first end, a middle portion, and a second end, said first end having a first jaw member thereon, said mounting member being fixed to said base;

an elongated beam member having a first end, a middle portion, and a second end, said first end having a second jaw member thereon, said middle portion being pivotally connected to said middle portion of said mounting member such that when said second end of said beam member pivots towards said second end of said mounting member, said first end of said beam member pivots away from said first end of said mounting member;

a spring connected to said first end of said beam member and connected to said first end of said mounting member in such a manner so as to force said first jaw member toward and in contact with said second jaw member;

a first guide element mounted on said first end of said mounting member adjacent said first jaw member;

a second guide element mounted on said second end of said mounting member; and a third guide element mounted on said second end of said beam member, whereby said cord extends through said first guide element, between said first and said second jaw members, through said second guide element, and finally through said third guide element such that when said cord is pulled said second end of said beam member is forced towards said second end of said mounting member thereby forcing said first jaw member away from said second jaw member and allowing said cord to freely slide therebetween.

6. The retractable arced window covering as defined in claim 1 further comprising a plurality of rigid support members attached to said foldable member, said support members extending from said lower end portion to said upper edge of said foldable member.

7. The retractable arced window covering as defined in claim 1 wherein said foldable member is made of a pleated fan-like material which is formed from an arc shaped piece of material.

8. The retractable arced window covering as defined in claim 1 further comprising a U-shaped rod having a pair of ends attached to said base, said rod fitting through a hole on said foldable member; and a bracket fixedly attached to said base between said ends of said rod, said bracket being pivotally connected to a lower end portion of said rigid member.

9. The retractable arced window covering as defined in claim 1 wherein said second track member comprises:

a bracket fixedly attached to said base, said bracket being pivotally connected about an axis to a lower end portion of said rigid member, and a pair of side members mounted to said base on either end of said bracket such that said side members are oriented perpendicular to said axis, said side members extend beyond said bracket such that said lower end portion of said foldable member extends between said pair of side members.

10. A retractable arced window covering comprising:

a base;

an arced track member including an arced hollow tube having a lateral opening therein, said arced track member rigidly attached to said base;

a first and a second rigid member each having a hook-shaped upper end pivotally mounted thereon, each said upper end slidably mounted within said lateral opening of said arced tube;

a first and a second arcuately foldable members each having an upper edge, a lower end portion, a first end and a second end, said first end of said first foldable member being connected to said first rigid member, said first end of said second foldable member being connected to said second rigid member, said second end of said first and said second foldable members being connected to said base, said first and said second foldable members being adaptable to assume a retracted position, an expanded position, and all positions therebetween; and a remotely operable cord connected to said upper end of said first and said second rigid members, said cord being capable of pulling said first and said second rigid members in opposite directions and in unison in both directions along said track member.

11. The retractable arced window covering as defined in claim 10 wherein said base has a horizontal side with four sides projecting vertically upward therefrom, said sides hiding from view said first and said second foldable members when said foldable members are in a retracted position upon said base.

12. The retractable arced window covering as defined in claim 10 further comprising:

a cover portion attached to said track member, said cover portion and said track member defining a channel;

a first balancing member fixed to said first foldable member, said first balancing member extending into said channel; and a second balancing member fixed to said second foldable member, said second balancing member extending into said channel.

13. The retractable arced window covering as defined in claim 10 further comprising means for locking said cord thereby locking said first and said second rigid members whereby said first and said second rigid members may be locked in any position along said track member.

14. The retractable arced window covering as defined in claim 13 wherein said means for locking said cord comprises:

an elongated mounting member having a first end, a middle portion, and a second end, said first end having a first jaw member thereon, said mounting member being fixed to said base;

an elongated beam member having a first end, a middle portion, and a second end, said first end having a second jaw member thereon, said middle portion being pivotally connected to said middle portion of said mounting member such that when said second end of said beam member pivots towards said second end of said mounting member, said first end of said beam member pivots away from said first end of said mounting member;

a spring connected to said first end of said beam member and connected to said first end of said mounting member in such a manner so as to force said first jaw member toward and in contact with said second jaw member;

a first guide element mounted on said first end of said mounting member adjacent said first jaw member;

a second guide element mounted on said second end of said mounting member; and a third guide element mounted on said second end of said beam member, whereby said cord extends through said first guide element, between said first and said second jaw members, through said second guide element, and finally through said third guide element such that when said cord is pulled said second end of said beam member is forced towards said second end of said mounting member thereby forcing said first jaw member away from said second jaw member and allowing said cord to freely slide therebetween.

15. The retractable arced window covering as defined in claim 10 further comprising a plurality of rigid support members attached to said first and said second foldable members, said support members extending from said lower end portion to said upper edge of said foldable members.

16. The retractable arced window covering as defined in claim 10 wherein said foldable members are made of a pleated fan-like material which is formed from an arc shaped piece of material.

17. The retractable arced window covering as defined in claim 10 further comprising a U-shaped rod, said rod having a pair of ends attached to said base, said rod fitting through holes on said foldable members; and a bracket fixedly attached to said base between said ends of said rod, said bracket being pivotally connected to lower end portions of said first and said second rigid members.

18. The retractable arced window covering as defined in claim 10 wherein said second track member comprises:

a bracket fixedly attached to said base, said bracket being pivotally connected about an axis to lower end portions of said first and said second rigid members; and a pair of side members mounted to said base on either end of said bracket such that said side members are oriented perpendicular to said axis, said side members extend beyond said bracket such that said lower end portions of said first and second foldable members extend between said pair of side members.

* * * * *